US012593897B2

(12) United States Patent
Si

(10) Patent No.: US 12,593,897 B2
(45) Date of Patent: Apr. 7, 2026

(54) STRAP BUCKLE

(71) Applicant: PGYTECH CO., LTD., Jiangsu (CN)

(72) Inventor: Dashan Si, Jiangsu (CN)

(73) Assignee: PGYTECH CO., LTD., Jiangsu (CN)

( * ) Notice: Subject to any disclaimer, the term of this patent is extended or adjusted under 35 U.S.C. 154(b) by 38 days.

(21) Appl. No.: 18/552,552

(22) PCT Filed: Sep. 24, 2021

(86) PCT No.: PCT/CN2021/120325
§ 371 (c)(1),
(2) Date: Sep. 26, 2023

(87) PCT Pub. No.: WO2022/205809
PCT Pub. Date: Oct. 6, 2022

(65) Prior Publication Data

US 2024/0180300 A1 Jun. 6, 2024

(30) Foreign Application Priority Data

Mar. 31, 2021 (CN) ..... 202120661024.7

(51) Int. Cl.
*A44B 11/26* (2006.01)
*A44B 11/25* (2006.01)

(52) U.S. Cl.
CPC ..... *A44B 11/2511* (2013.01)

(58) Field of Classification Search
CPC ..... Y10T 24/45681; Y10T 24/45675; Y10T 24/45644; Y10T 24/45649;
(Continued)

(56) References Cited

U.S. PATENT DOCUMENTS 4,584,858 A * 4/1986 Wolter ..... A44B 15/002 70/459
6,003,213 A 12/1999 Keller et al.
(Continued)

FOREIGN PATENT DOCUMENTS

CN 101980626 A 2/2011
CN 104883918 A 9/2015
(Continued)

OTHER PUBLICATIONS

International Searching Authority/China State Intellectual Property Office, International Search Report and Written Opinion issued in International Application No. PCT/CN2021/120325 on Jan. 6, 2022 (7 pages).

*Primary Examiner* — Jason W San
*Assistant Examiner* — Michael S Lee
(74) *Attorney, Agent, or Firm* — J. Peter Paredes; Amin Wasserman Gurnani LLP

(57) ABSTRACT

A strap buckle and an operation method therefor. The strap buckle includes a hang buckle main body, a fastener and a stop pin, wherein the hang buckle main body is configured to connect to a strap; the fastener is configured to connect to any position; the buckle main body is connected to the fastener, so as to be used for connecting the strap to any position; a locking cavity is arranged in the hang buckle main body, and the hang buckle main body is provided with a buckling slot; at least part of a structure of the fastener enters the locking cavity by means of the buckling slot; and the stop pin is movably arranged on the hang buckle main body, and the stop pin is configured to prevent the part of structure that enters the locking cavity from being separated from the interior of the locking cavity.

10 Claims, 9 Drawing Sheets

(58) Field of Classification Search
CPC ..... Y10T 24/45639; Y10T 24/45623; Y10T 24/45241; Y10T 24/47; Y10T 24/4736; A44B 11/258; A44B 11/2584; A44B 11/2588; A44B 11/2511; A44B 11/25
See application file for complete search history.

(56) References Cited

U.S. PATENT DOCUMENTS 6,233,788 B1 * 5/2001 Choy ..... A45F 5/02 24/669
8,794,682 B2 * 8/2014 Fiedler ..... A45C 13/1069 24/303
9,247,787 B2 * 2/2016 Dering ..... A44B 11/25
11,892,756 B2 * 2/2024 Ruckman ..... A45F 5/00
12,082,658 B1 * 9/2024 Qiu ..... A44B 11/2584
2001/0042273 A1 * 11/2001 Chaffee ..... A44B 11/2584 5/655.3
2007/0107169 A1 * 5/2007 Kung ..... A44B 11/258 24/308
2012/0102689 A1 * 5/2012 Kung ..... A44B 11/263 24/636
2015/0113772 A1 * 4/2015 Dering ..... A45F 5/00 24/591.1
2018/0078004 A1 * 3/2018 Baker ..... A44B 11/2584
2019/0380453 A1 * 12/2019 Hortnagl ..... A44B 11/2584
2021/0078526 A1 * 3/2021 Watanabe ..... A44B 11/25
2021/0378364 A1 * 12/2021 Cheng ..... A44B 11/258
2022/0134993 A1 * 5/2022 Watanabe ..... B60R 22/24 248/221.12
2024/0373989 A1 * 11/2024 Huang ..... A44B 11/258

FOREIGN PATENT DOCUMENTS

CN 212139597 U 12/2020
CN 112188847 A 1/2021

* cited by examiner

STRAP BUCKLE

CROSS-REFERENCES TO RELATED APPLICATIONS

This disclosure claims the priority of a Chinese patent application filed with the Chinese Patent Office on Mar. 31, 2021, with an application number of 2021206610247 and entitled "Strap Buckle", the entire content of which is incorporated into this disclosure by reference.

TECHNICAL FIELD

The invention generally relates to . . . . The present disclosure relates to the field of connecting members, and in particular, to a strap buckle.

BACKGROUND ART

All the time, camera straps are commonly used in the outdoor wearing for cameras, wherein the strap buckle is used more frequently during the wearing process. An easy-to-use strap buckle can greatly improve the user experience. When used outdoors, the camera strap has to withstand the shaking and pulling force of the camera as well, therefore the strap buckle also needs to have a higher strength.

At present, the strap buckles of many camera straps on the market are of a plug-in buckle structure or a metal ring structure. Here, the plug-in buckle has the defect of lacking enough strength, and the metal ring structure is more troublesome in use.

SUMMARY

The purpose of the present disclosure is to provide a strap buckle, which can realize quick connection and disassembly while improving the connection strength.

In embodiments of the present disclosure, a strap buckle is provided, comprising a hanging buckle body, a buckle member and a stop pin. The hanging buckle body is configured to be connected to a strap, and the buckle member is configured to be connected to an arbitrary position. The hanging buckle body is connected with the buckle member so as to connecting the strap at the arbitrary position. A locking cavity is provided in the hanging buckle body, and a buckle groove is provided on the hanging buckle body. At least partial structure of the buckle member enters the locking cavity through the buckle groove. The stop pin is movably (also called as "displaceably" or "removably") disposed on the hanging buckle body, and the stop pin is configured to prevent the partial structure that enters the locking cavity from being disengaged from the locking cavity.

In an optional embodiment, the buckle member comprises a buckle member body and a connecting member, and the buckle member body is movably connected to the hanging buckle body through the locking cavity, one end of the connecting member is connected to the buckle member body, and the other end of the connecting member is configured to be connected to the arbitrary position.

In an optional embodiment, the stop pin is disposed in the locking cavity, and the stop pin is configured to prevent the buckle member body or a partial structure of the buckle member body from being disengaged from the locking cavity.

In an optional embodiment, a connection manner between the buckle member body and the connecting member is an integral arrangement, a threaded connection, a welding or a riveting; or, a manner in which the other end of the connecting member is connected at the arbitrary position is an integral arrangement, a threaded connection, a welding, a riveting or a binding.

In an optional embodiment, a connecting groove is provided at one end of the hanging buckle body; the connecting groove is configured to connect the buckle member body and the strap after the connecting member passes through the connecting groove; and the connecting groove communicates with the locking cavity and the buckle groove.

In an optional embodiment, a baffle plate is provided on a groove wall of the connecting groove, and a gap is formed between the baffle plate and another groove wall of the connecting groove, and the connecting member can pass through the gap.

In an optional embodiment, the hanging buckle body is spherical.

In an optional embodiment, an inner side wall of the locking cavity is provided with an arc-shaped surface that cooperates with an outer side wall of the buckle member body.

In an optional embodiment, the arc-shaped surface is provided on a side wall in the locking cavity, with the side wall having a connecting groove.

In an optional embodiment, the stop pin is rotatably arranged in the locking cavity or the stop pin is slidably arranged in the locking cavity.

In an optional embodiment, when the stop pin is rotatably disposed in the locking cavity, a rotating shaft is arranged in the locking cavity, and the stop pin is arranged on the rotating shaft; when the stop pin is slidably arranged in the locking cavity, a sliding groove or a sliding protrusion is provided in the locking cavity, and a corresponding sliding protrusion or a sliding groove is provided on the stop pin.

In an optional embodiment, when the stop pin is rotatably disposed in the locking cavity, an axial direction of the rotating shaft is perpendicular to a direction in which the buckle member enters and exits the locking cavity; and when the stop pin is slidably arranged in the locking cavity, a sliding direction of the stop pin is perpendicular to a direction in which the buckle member enters and exits the locking cavity.

In an optional embodiment, a reset device is provided on the stop pin.

In an optional embodiment, an unlocking button is provided on the hanging buckle body, and the unlocking button is linked with the stop pin and is configured to drive the stop pin to disengage locking to the buckle member.

In an optional embodiment, the stop pin is shaped as a plate shape.

In an optional embodiment, the buckle member body is provided with a connecting hole, and the buckle member body is connected to the strap through the connecting hole.

The beneficial effects of the embodiments of the present disclosure are as follows.

The buckle member enters the locking cavity through the buckle groove on the hanging buckle body, and then the buckle member is stopped by the stop pin to connect the buckle member with the hanging buckle body; and by removing the stopping of the stop pin to the buckle member, the buckle member is taken out from the locking cavity, and then the quick connection of the strap buckle is realized.

BRIEF DESCRIPTION OF THE DRAWINGS

In order to explain the technical solutions of the embodiments of the present disclosure more clearly, the drawings needed to be used in the embodiments will be briefly introduced as follows. It should be understood that the following drawings only show certain embodiments of the present disclosure. Therefore, they should not be regarded as limitation to the scope. For those ordinarily skilled in the art, without creative work, other related drawings can be obtained from these drawings.

Figure 1:
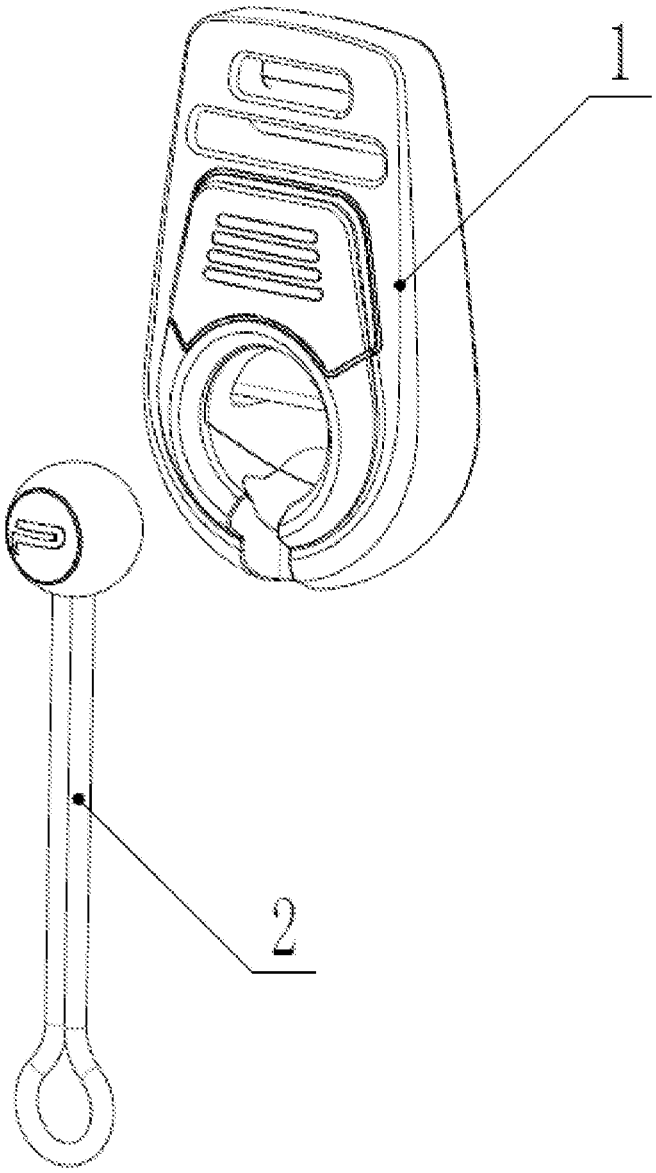
FIG. 1 is a schematic structural view of a strap buckle provided by an embodiment of the present disclosure.

Reference Numbers: 1—hanging buckle body; 2—buckle member; 3—hanging buckle front plate; 4—connecting hole; 5—stop pin; 6—torsion spring; 7—rotating shaft; 8—hanging buckle back plate; 9—buckle member body; 10—connecting member; 11—unlocking button; 12—locking cavity; 13—buckle groove; 14—connecting groove; 15—baffle plate; and 16—gap.

DETAILED DESCRIPTION OF THE INVENTION

In order to make the objectives, technical solutions, and advantages of the embodiments of the present disclosure clearer, the technical solutions in the embodiments of the present disclosure will be described below clearly and completely with reference to the drawings in the embodiments of the present disclosure. Obviously, the described embodiments are a part of the embodiments of the present disclosure, but not all of the embodiments. Generally, the components in the embodiments of the present disclosure described and illustrated in the drawings herein may be arranged and designed in a variety of different configurations.

Therefore, the following detailed description of the embodiments of the present disclosure provided in the drawings is not intended to limit the scope of the claimed present disclosure, but merely represents selected embodiments of the present disclosure. Based on the embodiments in the present disclosure, all other embodiments obtained by those ordinarily skilled in the art without creative work shall fall within the protection scope of the present disclosure.

It should be noted that similar reference numbers indicate similar items in the following drawings. Therefore, once one item is defined in one drawing, it does not need to be further defined and explained in the subsequent drawings.

In the description of the present disclosure, it should be noted that the orientation or position relationship indicated by the terms, "center", "upper", "lower", "left", "right", "vertical", "horizontal", "inner", "outer", etc. is based on the orientation or position relationship shown in the drawings, or is the orientation or position relationship in which the product is habitually placed in use. It is only for the convenience of describing the present disclosure and simplifying the description, rather than indicating or implying that the device or element referred to must be in the specific orientation, be constructed and operated in the specific orientation, and therefore it cannot be understood as a limitation to the present disclosure. In addition, the terms "first", "second", "third", etc. are only used for describing the distinguishing, and cannot be understood as indicating or implying the importance of relativity.

In addition, the terms "horizontal", "vertical", "overhanging" and other terms do not mean that the component is required to be absolutely horizontal or overhanging, but may be slightly inclined. For example, "horizontal" only means that its direction is more horizontal than "vertical", and it does not mean that the structure must be completely horizontal, but can be slightly inclined.

In the description of the present disclosure, it should also be noted that, unless otherwise clearly specified and defined, the terms "provide", "mount", "link", and "connect" should be understood in a broad sense. For example, they may be fixed connection, and also be detachably connected or integrally connected. It can be mechanically connected or electrically connected; and it can be directly connected or indirectly connected through an intermediate medium. Two components can be in the internal communication. For those ordinarily skilled in the art, the specific meanings of the above-mentioned terms in the present disclosure can be understood in specific situations.

Hereinafter, some embodiments of the present disclosure will be described below in detail with reference to FIGS. 1 to 5. In the case of no conflict, the following embodiments and features in the embodiments can be combined with each other.

Figure 2:
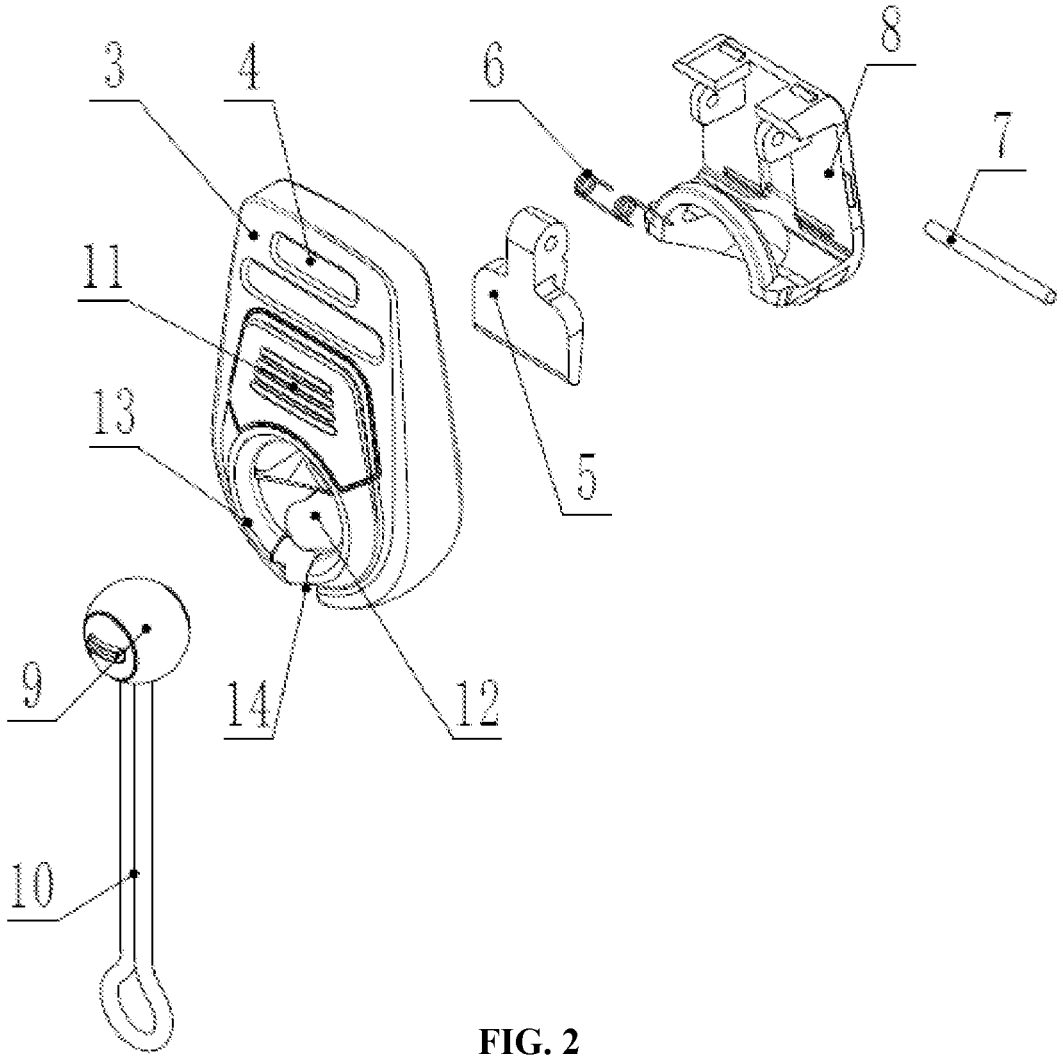
FIG. 2 is an exploded view of a strap buckle provided by an embodiment of the present disclosure.
Figure 3:
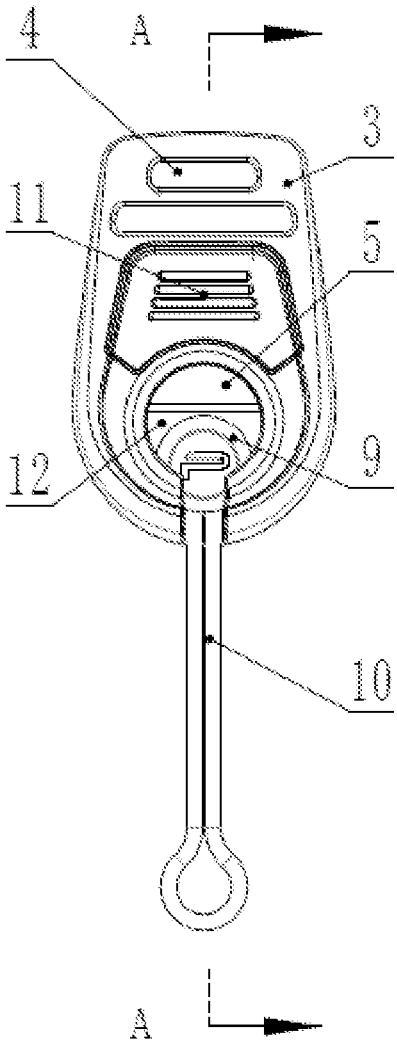
FIG. 3 is a front view of a strap buckle provided by an embodiment of the present disclosure.

The present disclosure provides a strap buckle, as shown in FIG. 1 and FIG. 2. The strap buckle includes a hanging buckle body 1, a buckle member 2 and a stop pin 5. The hanging buckle body 1 is configured to be connected to a strap, and the buckle member 2 is configured to be connected to an arbitrary position. The hanging buckle body 1 is connected with the buckle member 2, so as to connect the strap at arbitrary position. The hanging buckle body 1 is provided with a locking cavity 12 therein, and the hanging buckle body 1 is provided with a buckle groove 13 thereon. At least partial structure of the buckle member 2 enters the locking cavity 12 through the buckle groove 13, and the stop pin 5 is movably arranged on the hanging buckle body 1. The stop pin 5 is configured to prevent the partial structure which enters the locking cavity 12 from being disengaged from the locking cavity 12.

In this embodiment, the hanging buckle body 1 is connected with one strap, and the buckle member 2 can be connected to another strap or can be connected to the strap same as that of the hanging buckle body 1, to form a closed loop, and can also be connected to backpacks or other items. Thus, a closed loop is formed by the backpack and the strap together to realize the purpose of carrying the backpack on the back.

In this embodiment, the buckle member 2 is provided in the locking cavity 12 of the hanging buckle body 1 through the buckle groove 13, and then the buckle member 2 is stopped by the stop pin 5 to achieve the purpose of connecting the buckle member 2 onto the hanging buckle body 1.

Specifically, in this embodiment, the hanging buckle body 1 includes a hanging buckle front plate 3 and a hanging buckle back plate 8. After the hanging buckle front plate 3 and the hanging buckle back plate 8 are assembled, a locking cavity 12 is formed inside the hanging buckle body.

In an optional embodiment, the buckle member 2 includes a buckle member body 9 and a connecting member 10. The buckle member body 9 is movably connected to the hanging buckle body 1 through the locking cavity 12, and one end of the connecting member 10 is connected to the buckle member body 9, and the other end of the connecting member 10 is configured to connect to an arbitrary position.

Optionally, in this embodiment, the shape of the buckle member body 9 is spherical.

Optionally, in this embodiment, the buckle member body 9 is the main part of the buckle member 2. After the buckle member body 9 enters the locking cavity 12 through the buckle groove 13, the buckle member body 9 is prevented from being disengaged from the locking cavity 12 by the blocking of the stop pin 5, and one end of the connecting member 10 is connected to the buckle member body 9 and the other end thereof is fixed to the arbitrary position, so as to realize the connection between the buckle member body 9 and the arbitrary position, and finally realize the purpose of connecting the strap connected to the hanging buckle body 1 with the connection position of the buckle member 2.

In an optional embodiment, the stop pin is disposed in the locking cavity, and the stop pin is configured to prevent the buckle member body or the partial structure of the buckle member body from being disengaged from the locking cavity.

Optionally, in this embodiment, the stop pin 5 is disposed in the locking cavity 12. When the buckle member 2 enters the locking cavity 12 through the buckle groove 13, the stop pin 5 is moved so that the stop pin 5 blocks the buckle member 2, so as to prevent the buckle member 2 from being disengaged from the locking cavity 12.

Optionally, in this embodiment, the movement mode of the stop pin 5 can be the linear movement or rotation, as long as it can block the buckle member 2 so as to prevent the buckle member 2 entering the locking cavity 12 from being disengaged from the locking cavity 12.

In an optional embodiment, the connection manner between the buckle member body 9 and the connecting member 10 is an integral arrangement, the threaded connection, the welding or the riveting.

In this embodiment, the buckle member body 9 is a solid round ball, which has relatively high strength and durability, and is not easily damaged by external forces.

The buckle member body 9 is spherical, which can enter the locking cavity 12 from any direction and at any angle, which can be completed conveniently and quickly, and can be rotated in any direction in the locking cavity 12 without disturbing the connecting member 10.

Optionally, the buckle member body 9 can be rotated in a horizontal direction, or can be rotated in a vertical direction. The buckle member body can be rotated in any direction as long as it has enough space for rotation when the connecting member 10 does not interfere with the hanging buckle body 1.

Optionally, in this embodiment, the connecting member 10 is of a rope structure. A buckle cavity is provided inside the buckle member body 9, and a buckle hole communicating with the outside is provided on the buckle cavity. One end of the rope as the connecting member 10 is knotted and enters the buckle cavity, and the other end thereof is connected to the strap through the buckle hole.

Optionally, in this embodiment, it is also possible that one end of the rope is inserted into the buckle cavity through the buckle hole, and then a moldable medium is injected into the buckle cavity through the buckle hole, so that the one end of the rope extending into the buckle cavity is shaped to prevent the rope from being disengaged from the buckle cavity, so as to realize the fixation between the rope and the buckle member body 9.

In this embodiment, the connecting member 10 may also be of a rod structure, that is, one end of the connecting member 10 is a connecting rod, and the other end thereof is a connecting ring. Specifically, during use, the connecting rod is connected to the buckle member body 9 and the connecting ring is connected to the strap. More specifically, when the connecting rod is connected to the buckle member body 9, a welding method may be adopted or a threaded connection method may be used, that is, an external thread is provided on the connecting rod and a threaded hole is provided on the buckle member body 9. The external thread on the connecting rod is made to match with the internal thread on the threaded hole, so as to realize the connection between the connecting rod and the buckle member body 9.

It should be pointed out that the connecting member 10 can be arranged in the form of a rope structure or a rod structure, but it is not limited to the above two structures, and it can also be of other connecting structures, such as, the connecting member 10 may be of a chain structure, etc., that is, as long as the purpose of connecting the buckle member body 9 with the strap can be achieved.

It should also be pointed out that the connecting member 10 and the buckle member body 9 can be connected in a method of being snapped by means of rope knot, or being welded or threaded, but it is not limited to the above-mentioned methods and it can also be in other connection methods, such as, the pin shaft connection, riveting, etc., that is, as long as the purpose of connecting the connecting member 10 with the buckle member body 9 can be achieved.

In an optional embodiment, one end of the hanging buckle body 1 is provided with a connecting hole 4, and the other end of the hanging buckle body 1 is provided with a connecting groove 14, and the connecting groove 14 communicates with the locking cavity 12 and the buckle groove 13.

In this embodiment, the connecting hole 4 on the hanging buckle body 1 is configured to be connected with the strap to achieve the purpose of connecting the strap to an arbitrary position through the buckle member 2, so as to form a closed loop, so that it can be carried on user's back.

Optionally, in this embodiment, the number of the connecting hole(s) 4 on the hanging buckle body 1 may be one or more, and the specific number may be determined according to the shape, number, usage mode, etc. of the strap.

In this embodiment, the shape of the connecting hole 4 can be a circular hole, an oval hole, a square hole, a triangular hole, etc., that is, the shape of the connecting hole 4 can be any shape, as long as it can achieve the connection with the strap through the connecting hole 4.

In this embodiment, the other end of the hanging buckle body 1 is provided with a connecting groove 14, which communicates with the buckle groove 13 and the locking cavity 12, with the purpose as being able of facilitating the passage of the connecting member 10.

Optionally, in this embodiment, when the connecting member 10 is a rope, it is possible that the connecting groove 14 is not directly communicating with the buckle groove 13, but the connecting groove 14 is directly communicating with the locking cavity 12. At this time, the connecting member 10 enters the locking cavity 12 through the buckle groove 13 first, and then extends out through the connecting groove 14. After the buckle member body 9 enters the locking cavity 12 through the buckle groove 13, the connection between the buckle member body 9 and the strap is realized through the connecting member 10.

Optionally, in this embodiment, when the connecting member 10 is of a rod structure or is a rope, it is possible that the connecting groove 14, the buckle groove 13 and the locking cavity 12 can be directly communicated, respectively, as long as it can realize the normal buckle connection between the buckle member 2 and the hanging buckle body 1, and then realize the connection of the two straps.

In an optional embodiment, as shown in FIGS. 6 to 9, a baffle plate 15 is provided on the groove wall of the connecting groove 14, and there is a gap 16 between the baffle plate 15 and the another groove wall of the connecting groove 14, and the connecting member can pass through the gap 16.

In this embodiment, the baffle plate 15 is arranged at the position of the notch of the connecting groove 14, and the outer side surface of the baffle plate 15 is flush with the surface of the hanging buckle body 1.

When the buckle member body 9 enters the locking cavity 12, the connecting member enters the connecting groove 14 through the gap 16. Under the action of a pulling force, the connecting member 10 drives the buckle member body 9 to rotate, so that the connecting member 10 slides in the connecting groove 14, sliding from the side wall of one end close to the gap 16 to the side wall of one end away from the gap 16, so that the baffle plate 15 can block the connecting member 10 and prevent the connecting member 10 from being disengaged from the connecting groove 14.

That is, as shown in the drawings in FIGS. 6 to 9, when viewed from bottom to up, the shape of the connecting groove 14 is L-shaped.

In an optional embodiment, the inner side wall of the connecting groove 14 provided on the hanging buckle body 1 is provided with an arc-shaped surface that cooperates with the outer side wall of the buckle member body 9.

In this embodiment, the side wall of the locking cavity 12 in the hanging buckle body 1 is provided with an arc-shaped surface, and the arc-shaped surface is attached to the outer side wall of the buckle member body 9, and further, through the arrangement of the arc-shaped surface, the buckle member body 9, after entering the locking cavity 12, can move in a direction close to the connecting member 10, and then the buckle member body 9 is snapped in the locking cavity 12 to prevent the buckle member body 9 from being disengaged from the locking cavity 12 along the buckle groove 13, therefore ensuring the stability of the buckle member body 9 in the locking cavity 12.

Since the arc-shaped surface matches the shape of the outer side wall of the buckle member body 9, the operation is relatively simple when the two straps are separated so that the buckle member body 9 needs to be disengaged from the locking cavity 12.

It should be pointed out that the inner side wall of the locking cavity 12 can be provided with an arc-shaped surface or a groove, as long as the groove can limit the position of the buckle member body 9.

In an optional embodiment, the stop pin 5 is rotatably arranged in the locking cavity 12.

Figure 4:
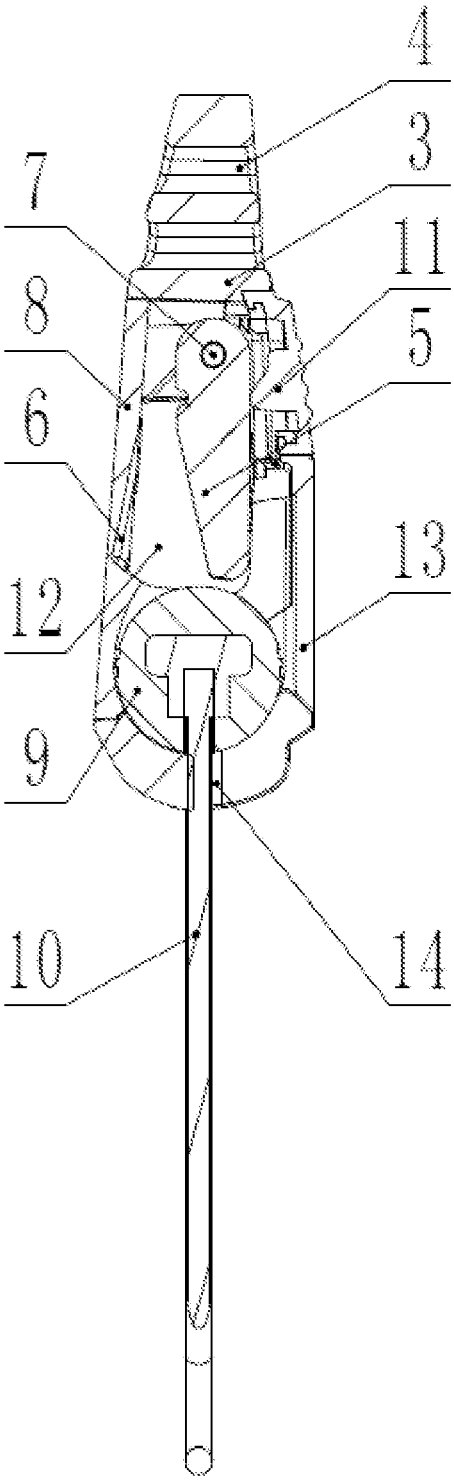
FIG. 4 is an A-A sectional view of FIG. 3 in the locked state.

In this embodiment, the mode of the stop pin 5 being arranged in the locking cavity 12 may be a rotating arrangement. As shown in FIG. 4, the stop pin 5 is rotatably arranged in the locking cavity 12 through the rotating shaft 7. Specifically, it is possible that the stop pin 5 is rotationally connected to the rotating shaft 7, and the rotating shaft 7 is fixedly connected to the inner wall of the locking cavity 12; and it is also possible that the stop pin 5 is fixedly connected to the rotating shaft 7, and the rotating shaft 7 is rotatably connected to the inner wall of the locking cavity 12. It is also possible that the stop pin 5 is rotatably connected to the rotating shaft 7, and the rotating shaft 7 is also rotatably connected to the inner wall of the locking cavity 12, as long as it realizes the rotation connection of the stop pin 5 in the locking cavity 12, in other words.

In use, when the buckle member body 9 enters the locking cavity 12, the stop pin 5, through rotation, makes the end of the stop pin 5 away from the rotating shaft 7 rotate to the position of the buckle groove 13. When the buckle member body 9 is intended to be disengaged from the locking cavity 12, the buckle member body is stopped by the stop pin 5 and cannot move upward, and further cannot be disengaged from the locking cavity 12.

Figure 5:
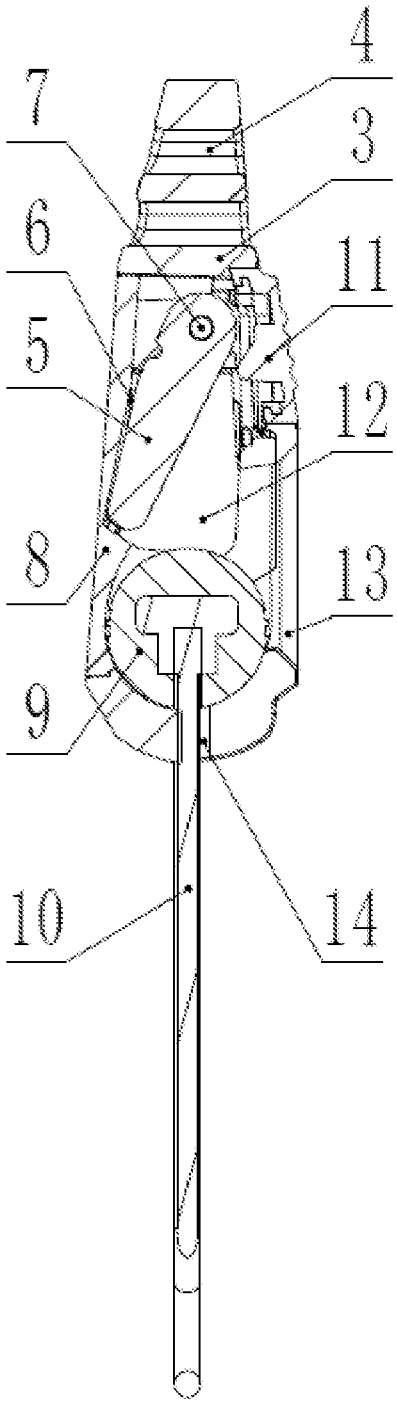
FIG. 5 is an A-A sectional view of FIG. 3 in the unlocked state.
Figure 6:
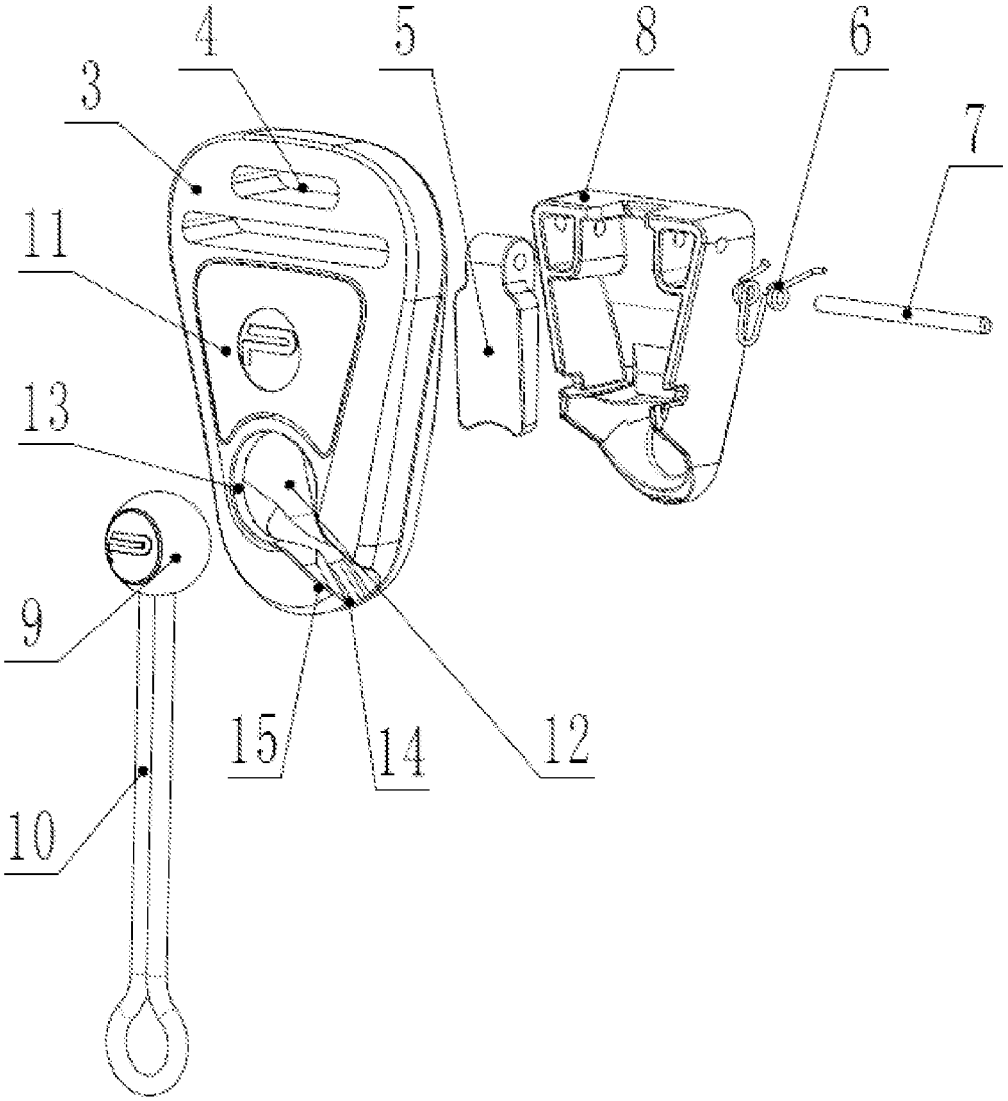
FIG. 6 is an exploded view of another implementation of the strap buckle provided by the embodiment of the present disclosure.
Figure 7:
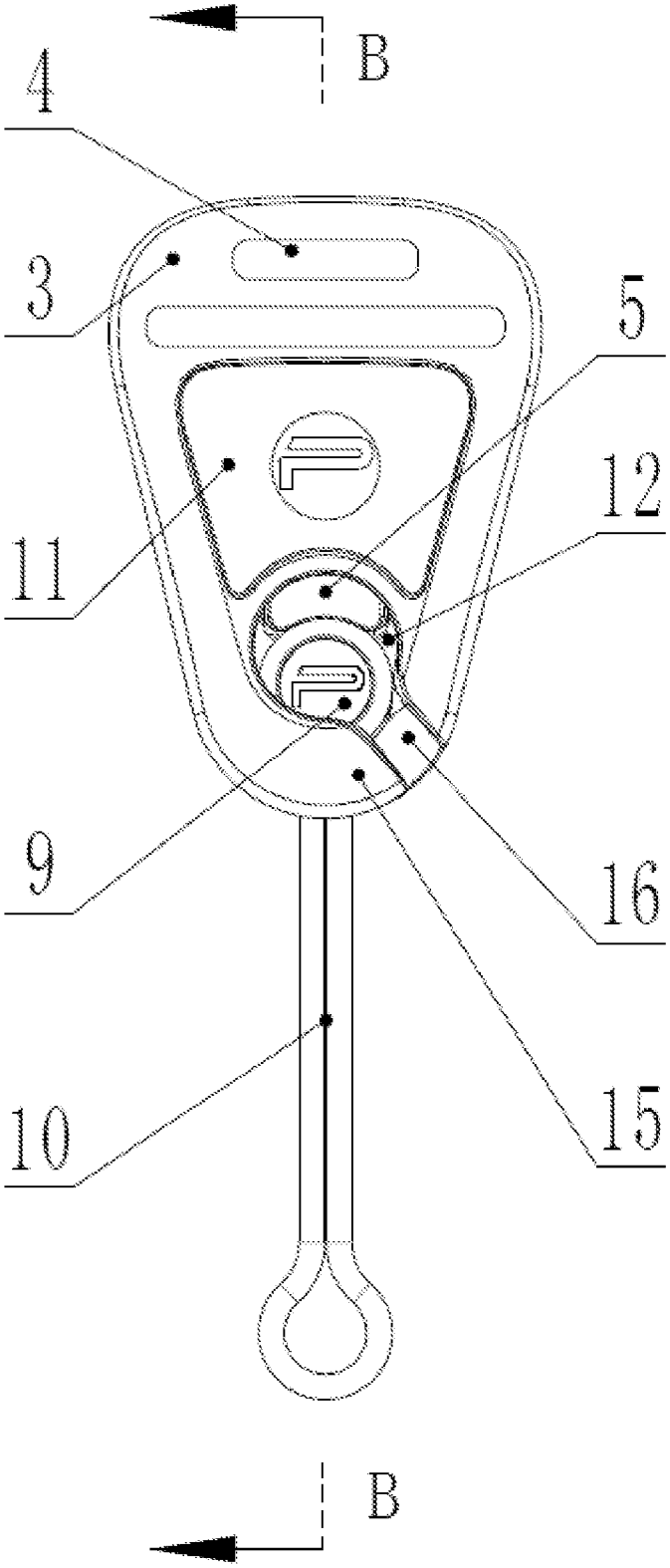
FIG. 7 is a front view of another implementation of the strap buckle provided by the embodiment of the present disclosure.
Figure 8:
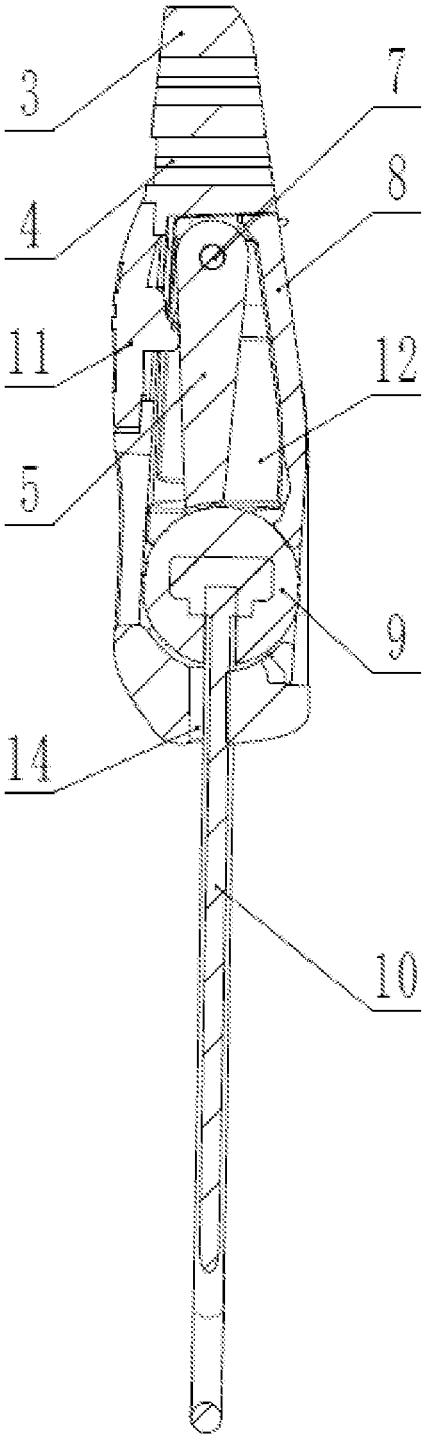
FIG. 8 is a B-B sectional view of FIG. 7 in a locked state.
Figure 9:
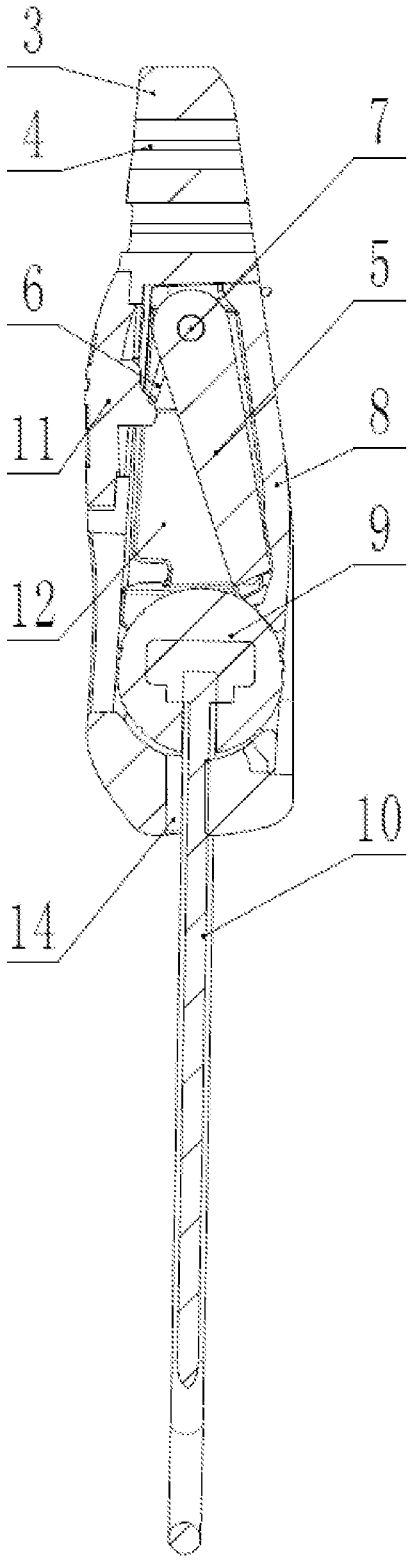
FIG. 9 is a B-B sectional view of FIG. 7 in an unlocked state.

When the spherical buckle member body 9 needs to be disengaged from the locking cavity 12, the end of the stop pin 5 away from the rotating shaft 7 rotates around the rotating shaft 7 so that it is away from the notch position of the buckle groove 13, as shown in FIG. 5. The buckle member body 9 can normally move upwards, so that it can pass through the buckle groove 13 and is disengaged from the locking cavity 12 to realize the separation of the two straps.

In this embodiment, the rotation of the stop pin 5 may be driven manually, or by other devices, such as a motor.

In an optional embodiment, the stop pin 5 is slidably arranged in the locking cavity 12.

In this embodiment, the stop pin 5 is mechanically slidably arranged in the locking cavity 12, and for example, it can slide left and right, or it can slide up and down, and it can be positioned at both ends of the sliding track to avoid arbitrary sliding.

In use, when the buckle member body 9 enters the locking cavity 12, the stop pin 5 is driven to slide, so that the stop pin 5 slides to a position between the buckle member body 9 and the buckle groove 13, and the stop pin 5 is positioned, so as to prevent the buckle member body 9 from passing through the buckle groove 13 and being disengaged from the locking cavity 12, which further ensures the stability of the connection between the two straps. When the buckle member body 9 needs to be disengaged from the locking cavity 12, the stop pin 5 slides reversely such that the stop pin 5 moves away from the position between the buckle member body 9 and the buckle groove 13, and the stop pin 5 is positioned to prevent the stop pin 5 from returning to the position between the buckle member body 9 and the buckle groove 13 automatically, and therefore, it is ensured that the buckle member body 9 can pass through the buckle groove 13 and be disengaged from the locking cavity 12.

Optionally, in this embodiment, the mode of the stop pin 5 sliding in the locking cavity 12 can be a linear sliding or arc-shaped sliding, as long as the buckle member body 9 can be stopped by sliding of the stop pin 5.

When the stop pin 5 is rotatably arranged in the locking cavity 12, a rotating shaft is arranged in the locking cavity 12, and the stop pin 5 is arranged on the rotating shaft. When the stop pin 5 is slidably arranged in the locking cavity 12, the locking cavity 12 is provided therein with a sliding groove or a sliding protrusion, and corresponding sliding protrusion or sliding groove are provided on the stop pin 5.

Optionally, in this embodiment, when the stop pin 5 is rotatably arranged in the locking cavity 12, the axial direction of the rotating shaft is perpendicular to the direction in which the buckle member body 9 enters and exits the locking cavity.

In other words, when the direction in which the buckle member body 9 enters and exits the locking cavity is the front-rear direction, the rotation direction of the stop pin 5 may be the left-right direction or the up-down direction.

When the stop pin 5 is slidably arranged in the locking cavity 12, the sliding direction of the stop pin 5 is perpendicular to the direction in which the buckle member body 9 enters and exits the locking cavity 12.

That is, when the direction in which the buckle member body 9 enters and exits the locking cavity is the front-rear direction, the sliding direction of the stop pin 5 can be the left-right direction, or the up-down direction, or any direction parallel to the plane formed by the up-down direction and the left-right direction.

In an optional embodiment, a reset device is provided on the stop pin 5.

In this embodiment, the stop pin 5 is provided with a reset device, so that the stop pin 5 can always be in the locking position with respect to the buckle member body 9 under the action of the reset device. When unlocking is required, the stop pin 5 is moved or rotated, and after the buckle member body 9 is disengaged from the locking cavity 12, the stop pin 5 is restored to the initial position for locking the buckle member body 9 under the action of the reset device.

With such arrangement, the positioning of the stop pin 5 in the two states can be realized by the reset device, and the structure is relatively simple, and the operation is convenient and quick.

In an optional embodiment, the reset device is a pullback spring, a torsion spring 6, a compression spring or an elastic sheet.

Optionally, in this embodiment, when the mode of the stop pin 5 being arranged in the locking cavity 12 is a rotary arrangement, the reset device may be a torsion spring 6. The torsion spring 6 is sleeved over the rotating shaft 7, and one protruding end of the torsion spring 6 abuts against the inner wall of the locking cavity 12, and the other protruding end of the torsion spring 6 abuts against one side of the stop pin 5.

Optionally, when the mode of the stop pin 5 being arranged in the locking cavity 12 is a sliding arrangement, the reset device may be a compression spring or a pullback spring. One end of the compression spring abuts against one end of the stop pin 5, and the other end of the compression spring abuts against the inner wall of the locking cavity 12. Or one end of the pullback spring is hooked to one end of the stop pin 5, and the other end of the pullback spring is hanged to the inner wall of the locking cavity 12.

It should be pointed out that the reset device can be the above-mentioned torsion spring 6, pullback spring or compression spring, but it is not limited to the above several arrangement modes, and it can also be other reset devices, such as elastic sheets, and air pressure, hydraulic pressure and other methods can be used for resetting, that is, as long as the restoring of the position of the stop pin 5 can be realized.

In an optional embodiment, an unlocking button 11 is provided on the hanging buckle body 1, and the unlocking button 11 is linked with the stop pin 5 and is configured to drive the stop pin 5 to be disengaged from the locking on the buckle member 2.

Optionally, an unlocking hole is provided on the hanging buckle body 1, and the unlocking button 11 is connected to the stop pin 5 through the unlocking hole to realize the manual driving to the stop pin 5, thereby realizing that the stop pin 5 is changed from the locked state to the unlocked state.

Optionally, in this embodiment, when the stop pin 5 is rotatably arranged in the locking cavity 12, the unlocking button 11 passes through the unlocking hole and then abuts against the stop pin 5. When the unlocking button 11 is pressed in a direction toward the locking cavity 12, the stop pin 5 can be driven to rotate, so that the buckle member body 9 can be smoothly disengaged from the locking cavity 12.

Optionally, in this embodiment, when the stop pin 5 is slidably arranged in the locking cavity 12, the unlocking hole is a bar-shaped hole, and the unlocking button 11 passes through the unlocking hole to be fixedly connected to the stop pin 5. The unlocking button 11 slides in the bar-shaped hole, thereby driving the stop pin 5 to slide in the locking cavity 12, so as to realize the change of the locking body of the buckle member body 9.

Optionally, in this embodiment, a rubber pad or a rubber sleeve is provided on the unlocking button 11, so that the unlocking button 11 can be effectively protected.

It should be pointed out that the unlocking button 11 is also provided with an elastic device, so that the unlocking button 11 is in a non-pressing state normally.

In an optional embodiment, the stop pin 5 is plate-shaped.

The plate-shaped arrangement can increase the strength of the stop pin 5.

It should be pointed out that the stop pin 5 may be plate-shaped, or of other shapes, such as column-shaped.

The beneficial effects of the embodiments of the present disclosure are as follows.

The buckle member 2 enters the locking cavity 12 through the buckle groove 13 on the hanging buckle body 1, and then the buckle member 2 is stopped by the stop pin 5 to connect the buckle member 2 with the hanging buckle body 1; and by removing the stopping of the stop pin 5 with respect to the buckle member 2, the buckle member 2 is taken out of the locking cavity 12, so as to realize the quick connection of the strap buckle.

The above descriptions are only preferred embodiments of the present disclosure, and are not intended to limit the present disclosure. For those skilled in the art, the present disclosure can have various modifications and changes. Any modifications, equivalent replacements, improvements, etc. made within the spirit and principle of the present disclosure shall be included in the protection scope of the present disclosure.

INDUSTRIAL APPLICABILITY

In summary, the present disclosure provides a strap buckle, which can realize quick connection and disassembly while improving the connection strength. The strap buckle has high endurance and is convenient to use, therefore it can greatly improve the user experience.

What is claimed is:

1. A strap buckle, comprising a hanging buckle body, a buckle member and a stop pin, wherein the hanging buckle body is configured to be connected to a strap, and the buckle member is configured to be connected to an arbitrary position;

the hanging buckle body is connected with the buckle member for connecting the strap at the arbitrary position;

a locking cavity is provided in the hanging buckle body, and a buckle groove is provided on the hanging buckle body;

the buckle member comprises a buckle member body and a connecting member, the buckle member body of the buckle member enters the locking cavity through the buckle groove;

the stop pin is movably disposed on the hanging buckle body, the stop pin is disposed in the locking cavity, and the stop pin is configured to prevent the buckle member body that enters the locking cavity from being disengaged from the locking cavity, and the stop pin is provided with a torsion spring, so that the stop pin is capable of always being restored in a locking position with respect to the buckle member body under an action of the torsion spring;

the buckle member body is movably connected to the hanging buckle body through the locking cavity, one end of the connecting member is connected to the buckle member body, and the other end of the connecting member is configured to be connected to the arbitrary position;

the stop pin is rotatably arranged in the locking cavity;

a rotating shaft is arranged in the locking cavity, and the stop pin is arranged on the rotating shaft;

an axial direction of the rotating shaft is perpendicular to a direction in which the buckle member enters and exits the locking cavity;

the stop pin is shaped as a plate shape; and an unlocking button is provided on the hanging buckle body, and an unlocking hole is provided on the hanging buckle body, the unlocking button passes through the unlocking hole and then abuts against the stop pin, when the unlocking button is pressed in a direction toward the locking cavity, the stop pin is driven to rotate, so that the buckle member body is disengagable from the locking cavity.

2. The strap buckle according to claim 1, wherein a connection manner between the buckle member body and the connecting member is an integral arrangement, a threaded connection, a welding or a riveting;

or, a manner in which the other end of the connecting member is connected at the arbitrary position is an integral arrangement, a threaded connection, a welding, a riveting or a binding.

3. The strap buckle according to claim 1, wherein a connecting groove is provided at one end of the hanging buckle body; the connecting groove is configured to connect the buckle member body and a strap after the connecting member passes through the connecting groove; and the connecting groove communicates with the locking cavity and the buckle groove.

4. The strap buckle according to claim 3, wherein a baffle plate is provided on a groove wall of the connecting groove, and a gap is formed between the baffle plate and another groove wall of the connecting groove, and the connecting member is able to pass through the gap.

5. The strap buckle according to claim 3, wherein the buckle member body is spherical.

6. The strap buckle according to claim 5, wherein an inner side wall of the locking cavity is provided with an arc-shaped surface that cooperates with an outer side wall of the buckle member body.

7. The strap buckle according to claim 6, wherein the arc-shaped surface is provided on a side wall in the locking cavity, with the side wall having a connecting groove.

8. The strap buckle according to claim 1, wherein a reset device is provided on the stop pin.

9. The strap buckle according to claim 1, wherein the hanging buckle body is provided with a connecting hole.

10. The strap buckle according to claim 1, wherein the stop pin is disposed in the locking cavity, and the stop pin is configured to prevent the buckle member body or a partial structure of the buckle member body from being disengaged from the locking cavity.

* * * * *